US009653227B2

(12) United States Patent
Mueller

(10) Patent No.: US 9,653,227 B2
(45) Date of Patent: May 16, 2017

(54) MECHANICALLY LOCKABLE HAND SWITCH

(71) Applicant: DEWERTOKIN GMBH, Kirchlengern (DE)

(72) Inventor: Christian Mueller, Steinheim (DE)

(73) Assignee: DEWERTOKIN GMBH, Kirchlengern (DE)

( * ) Notice: Subject to any disclaimer, the term of this patent is extended or adjusted under 35 U.S.C. 154(b) by 19 days.

(21) Appl. No.: 14/350,947

(22) PCT Filed: Oct. 10, 2012

(86) PCT No.: PCT/EP2012/070069

§ 371 (c)(1),
(2) Date: Aug. 13, 2014

(87) PCT Pub. No.: WO2013/053764

PCT Pub. Date: Apr. 18, 2013

(65) Prior Publication Data

US 2014/0353134 A1 Dec. 4, 2014

(30) Foreign Application Priority Data

Oct. 13, 2011 (DE) ..... 10 2011 084 464

(51) Int. Cl.
*H01H 9/26* (2006.01)
*H01H 13/72* (2006.01)
(Continued)

(52) U.S. Cl.
CPC ..... *H01H 9/223* (2013.01); *H01H 3/20* (2013.01); *H01H 3/38* (2013.01); *H01H 3/46* (2013.01);
(Continued)

(58) Field of Classification Search
CPC ..... H01H 9/26; H01H 13/72; H01H 13/76; H01H 3/00; H01H 3/02; H01H 3/12;
(Continued)

(56) References Cited

U.S. PATENT DOCUMENTS 4,504,707 A 3/1985 Ochiai
4,882,458 A 11/1989 Berg et al.
(Continued)

FOREIGN PATENT DOCUMENTS

CN 102097224 A 6/2011
DE 3543216 A1 6/1987
(Continued)

OTHER PUBLICATIONS

Int'l Search Report issued Jan. 22, 2013 in Int'l Application No. PCT/EP2012/070069.
(Continued)

*Primary Examiner* — Anthony R. Jimenez
(74) *Attorney, Agent, or Firm* — Panitch Schwarze Belissario & Nadel LLP

(57) ABSTRACT

A switch for controlling a control circuit or an operating current of electric-motors in linear gear drives includes: a switch casing, having at least an upper part including keys, and a lower part for forming a receiving space; a circuit board incorporated in the receiving space with micro-switches including a switch casing and a spring-biased push-rod therein; wherein, when the keys are actuated by a user, the push rod actuates the micro-switch to control a control circuit or operating current, and wherein the switch contains at least one locking element, transferable between a locking position, which locks the keys, and a release position, which releases the keys. To prevent damage to a switch from pressure forces during actuation, the locking device is formed such that the pressure applied to the key is
(Continued)

transferred onto the switch casing and/or the circuit board plate over as wide an area as possible.

5 Claims, 11 Drawing Sheets

(51) Int. Cl.

| | |
|---|---|
| ***H01H 13/76*** | (2006.01) |
| ***H01H 9/22*** | (2006.01) |
| ***H01H 3/20*** | (2006.01) |
| ***H01H 9/02*** | (2006.01) |
| ***H01H 3/38*** | (2006.01) |
| ***H01H 3/46*** | (2006.01) |
| ***H01H 13/86*** | (2006.01) |
| *H01H 13/52* | (2006.01) |

(52) U.S. Cl.
CPC ..... *H01H 9/0235* (2013.01); *H01H 13/86* (2013.01); *H01H 13/52* (2013.01)

(58) Field of Classification Search
CPC ..... H01H 3/161; H01H 3/32; H01H 9/00; H01H 9/02; H01H 9/0214; H01H 9/04; H01H 9/20; H01H 9/22; H01H 9/223; H01H 13/00; H01H 13/04; H01H 13/10; H01H 13/12; H01H 13/14; H01H 13/20; H01H 13/50; H01H 3/20; H01H 3/38; H01H 3/46; H01H 9/0235; H01H 13/86; H01H 13/52; H01H 2071/505; H01H 2009/20; H01H 9/24; H01H 9/045; H01H 2221/052; E05B 17/22
USPC ..... 200/5 A, 318.1, 318.2, 321–325
See application file for complete search history.

(56) References Cited

U.S. PATENT DOCUMENTS

| | | | | |
|---|---|---|---|---|
| 5,803,237 | A | 9/1998 | Gandre et al. | |
| 6,201,199 | B1 | 3/2001 | Chew et al. | |
| 2009/0173613 | A1* | 7/2009 | Geldmacher | E05B 19/04 200/5 A |

FOREIGN PATENT DOCUMENTS

| | | | |
|---|---|---|---|
| EP | 0307601 | A2 | 3/1989 |
| EP | 0480221 | A2 | 4/1992 |
| EP | 0655757 | A2 | 5/1995 |
| GB | 2183917 | A | 6/1987 |
| JP | 2010-104792 | A | 5/2010 |
| WO | 2005036576 | A1 | 4/2005 |

OTHER PUBLICATIONS

Office Action issued Jun. 27, 2012 in DE Application No. 10 2011 084 464.3.
Int'l Preliminary Report on Patentability issued Apr. 15, 2014 in Int'l Application No. PCT/EP2012/070069.

* cited by examiner

MECHANICALLY LOCKABLE HAND SWITCH

CROSS-REFERENCE TO RELATED APPLICATIONS

This application is a Section 371 of International Application No. PCT/EP2012/070069, filed Oct. 10, 2012, which was published in the German language on Apr. 18, 2013, under International Publication No. WO 2013/053764 A1 and the disclosure of which is incorporated herein by reference.

BACKGROUND OF THE INVENTION

The invention concerns a switch for controlling a control current for the control of an operating current of electric motors in linear transmissions, for example for the actuation of sick-beds, tables or the like. Such switches comprise a switch housing having at upper part including buttons and a lower part for forming a receiving space. Received in the receiving space is a circuit board having microswitches which have a switch housing and a spring-biased pushrod therein. Upon actuation of the buttons by a user the elastic or resilient button is depressed on to the pushrod of the microswitch and thus actuates the microswitch for controlling the control current. In addition such a hand switch has at least one locking device which can be displaced by the user from a locking position of locking the button into a release position of releasing the buttons.

Such switches which are in the form of hand switches are known for example from EP 0 480 221 B1 and WO 2005/036576. Both specifications are concerned with the problems of mechanical locking devices for the buttons in a hand control or a hand switch. Those hand switches include one or more buttons in an upper part which is connected to a lower part. Provided between the upper part and the lower part is a receiving space in which there is arranged a circuit board on which microswitches are fixed. Those microswitches have a spring-biased button arrangement which is depressed upon actuation of the buttons of the upper casing part and thus controls the control current for actuation of the operating current for the electrically operated drive or drives. Usually the two respective buttons are arranged in juxtaposed paired relationship in order to respectively permit the two opposite modes of operation for a respective electric motor.

The proposed solutions propose locking devices which are rotatable about a central axis and which can be rotated from the release position into the locking position. In the locking position the locking devices block the buttons to prevent them from being depressed in the upper part on to the pushrods of the microswitches. They therefore bear in contact between the underside of the elastic buttons and the upper part of the housing of the microswitch in such a way that it is not possible for the buttons to be pressed down on to the pushrod of the microswitch. In the rotated release position the two laterally projecting locking arms of the locking device free that arresting action and allow the buttons to be pressed down on to the microswitches.

EP 0 480 221 B1 operates with pneumatic switches, but with a similar principle with a rotatable locking device which in the locking position prevents the buttons from being pressed down by engagement at one side into the opening. That has the disadvantage that the one-sided displacement can cause tilting of the buttons. WO 2005/036576 discloses a further configuration of a mechanical locking arrangement.

Those mechanical locking arrangements transmit the locking forces to the microswitch and to the circuit board on which the microswitch is soldered. In ongoing operation that can result in destruction of the microswitch and/or the solder joints, and that then results in a system fault.

BRIEF SUMMARY OF THE INVENTION

The object of the invention is to further develop a hand switch of the general kind set forth in such a way that the disadvantages of the state of the art are at least partially avoided and in particular destruction of the solder joints of the circuit board and system components by excessively heavy loadings on the buttons is prevented.

That object is already attained in that the locking element is adapted to transmit the pressure applied to the button to the switch housing and/or the circuit board over as large an area as possible. That is effected by way of an arm which can be introduced under the button or buttons and which in that position either locks the button to prevent it from being depressed (locking arm) or which by introduction first bridges over an intermediate space between the underside of the button and the top side of the pushrod so that it is only after introduction that a pressure on the button can cause actuation of the microswitch (bridging arm). Preferably the bridging arm is of an elastic nature.

In a first preferred embodiment the locking device has a longitudinally displaceable locking element which is adapted to be transferred from a lowered release position into a lifted locking position, when a translatory movement is performed. In the lowered release position therefore it is possible for the buttons to be pressed down on to the pushrod of the microswitches. Upon displacement into the locking position, the locking element—also referred to as the locking slider—performs such a vertical movement that the locking element either bears against the housing or the switch housing or both and thus prevents the buttons from being depressed, but at the same time it also transmits the pressure forces at least for the major part to the switch housing and not to the delicate system components.

Preferably the means for performing the heightwise displacement of the locking element include inclined run-on ramps which are operative in pairs in mutually opposite and complementary relationship and which in the course of the translatory movement slide against each other, with a displacement in respect of height.

It is also possible that the locking element surrounds the circuit board on the outside, that is to say it bears on the housing lower part, and only a horizontally extending locking or bridging arm extends at least portion-wise over the circuit board, but does not necessarily have to be in contact therewith. Another solution provides that the locking device is adapted to transmit the pressure forces to the circuit board over the complete surface area thereof. Preferably in that respect the housing has a housing portion at which the circuit board is supported over a surface area so that no delicate system components carry the pressure forces.

In the displaceable structures discussed above the locking element performs a translatory movement which is sometimes converted into a lifting/lowering movement. In a basically different solution the locking element is in the form of a rotary element which performs a rotary movement about an axis of rotation. Preferably the locking element, with its axis of rotation extending in a longitudinal direction, extends vertically in the switch housing. As in that embodiment the locking element generally extends transversely relative to the longitudinal axis of the circuit board it can thus also extend through an opening in the circuit board for the transmission of force to the switch housing and to avoid loadings on the circuit board. That structure therefore has the advantage that the pressure forces are transmitted to the housing and/or the circuit board by way of the rotary element, whereby that structure basically requires less structural space than the translatory structures. In addition rotary structures can be sealed off more easily, for example by a simple O-ring.

The locking element has preferably locking and/or bridging arms which project in diametrically opposite relationship and which can be of such a geometrical configuration as to avoid collision with components disposed in the switch, in the rotary region. Naturally, depending on the respective situation of use and the geometrical factors in the switch, the arms can also be arranged differently relative to each other.

In another preferred embodiment the lockable switch is fitted into a side portion of a bed. The mechanical locking device for the buttons is very universal and can be easily adapted to different types of microswitches. In that respect it is possible to use different configurations of microswitches in the switch. A first structure of microswitches is of a small structural height and switches a control circuit for the actuation of a load relay which switches the respective operating current of the electric motors. The advantage of the mechanical locking device is that it can be adapted to the flat microswitches so that a hand switch for a bed or for a chair can also be of a very flat and shallow configuration. Another form of microswitches has other switching contacts which directly switch the operating current of the electric motors. The advantage in that respect lies in the simple structure and ease with which they can be assembled.

Preferably the proposed switch is made from plastic, in particular ABS or polyamide or combinations thereof.

What is essential in all proposed solutions is that the locking element is adapted, in the locking position, to transmit the pressure force exerted on the button or buttons over as large a surface area as possible, in particular preferably to the housing or to the circuit board and the housing. It can also be transmitted at least partially to the switch housing of the microswitches, to the circuit board and to the housing. Force transmission over a large surface area is crucial, to avoid stress peaks.

The proposed lockable switch is preferably in the form of a hand switch which for example can be connected to the linear transmission by way of a cable, but it can equally well be in the form of a chair switch which for example is integrated in the armrest or backrest of a chair.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

Further details, advantages and features of the invention will be apparent from the specific description hereinafter in which preferred embodiments of the invention are set forth and described in fuller detail. In the drawing.

DETAILED DESCRIPTION OF THE INVENTION

Identical parts or parts having the same action are denoted by the same references.

Figure 1A:
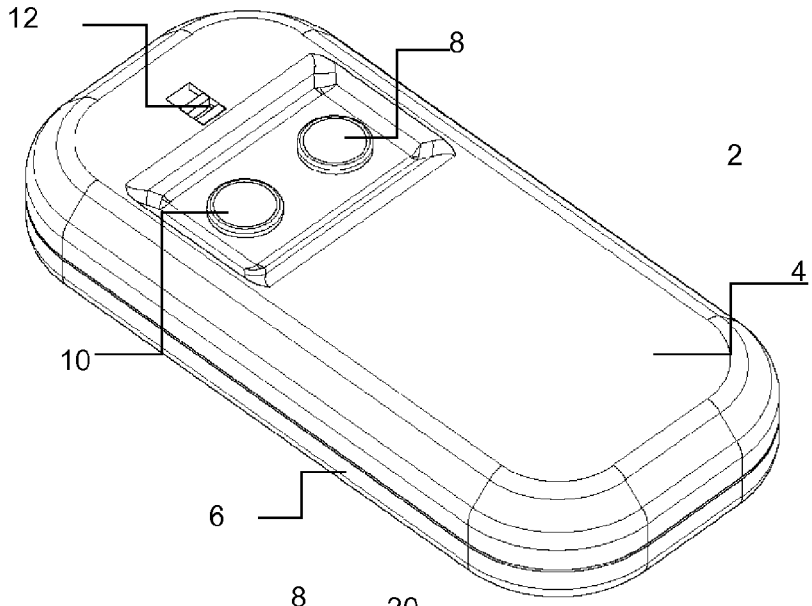
FIG. 1A shows a perspective view of a first embodiment of the mechanical locking switch in the form of a hand switch for a chair.

Accordingly the hand switch 2 shown as a perspective view in FIG. 1A comprises an elongate switch housing formed by an upper part 4 and a lower part 6 which are each in the form of a half-shell portion and the edges of which are joined together at the joint locations, enclosing a receiving space, preferably being connected releasably for repair purposes. The geometrical configuration of the hand switch is not relevant in the present case and here only represents a preferred embodiment.

The hand switch 2 comprises two buttons 8, 10 which respectively form a pair and which are intended to control an electric motor of a linear transmission for the chair in the one direction and in the opposite direction. Signal transmission from the hand switch to the electric motor is effected either by way of a cable (not shown) connected to the hand switch 2, or by way of wireless transmission.

The actuating end 12 of a locking slider received within the hand switch for locking the buttons 8, 10 projects through a rectangular opening in the upper part 4 above the pair of buttons in such a way that actuation is possible by insertion of a pointed article, for example a pen or pencil, into a pressing-in opening at the top side of the actuating end 12.

Figure 1B:
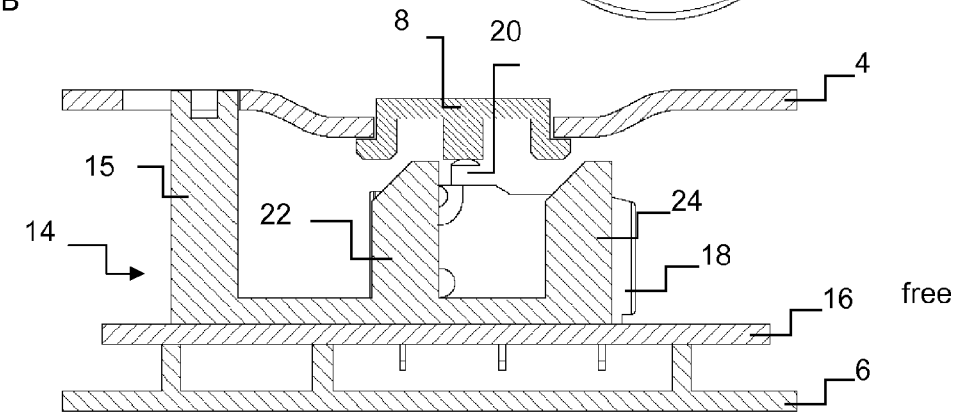
FIG. 1B shows an enlarged longitudinal section of the region of the buttons of the hand switch shown in FIG. 1A in the release position.
Figure 1C:
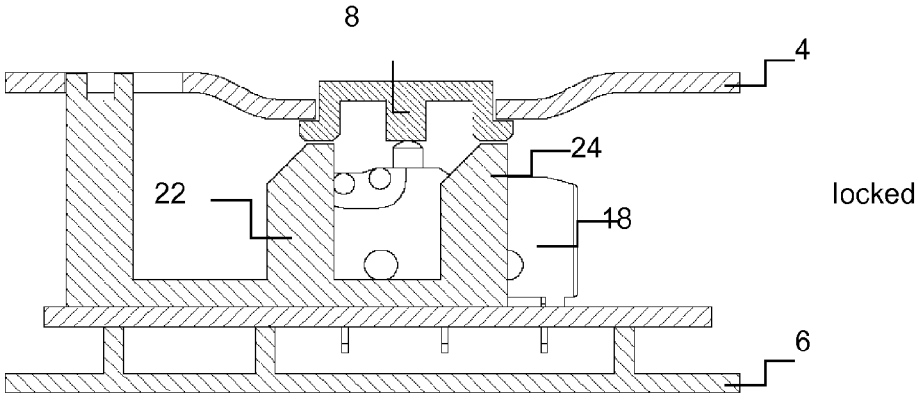
FIG. 1C shows an enlarged longitudinal section of the buttons of the hand switch shown in FIG. 1A in the locking position.

FIGS. 1B and 1C show an enlarged longitudinal section through the hand switch 2 in the region of the buttons 8, 10. In accordance therewith the lower part 6 includes a plurality of mutually spaced vertical legs, on which a circuit board 16 is fixed by fixing screws (not shown) or after assembly of the housing parts 4, 6. Arranged on the circuit board 16, besides the required circuits and electrical components, there are in particular two microswitches 18 which are arranged in corresponding relationship with the buttons and of which in the present case only the microswitch 18 associated with the button 8 is visible here. Each microswitch comprises a switch housing, from the top side of which a spring-biased pushrod 20 projects. The pushrod 20 is arranged in the installation position beneath a downwardly projecting vertical leg of the button 8. The button 8 is in the form of a plastic element which is in the shape of a cover and which has a peripherally extending flange which in the installation position embraces the edge of a through opening for the buttons 8, 10 in the upper part 4.

In the release position shown in FIG. 1B the buttons 8, 10 can be pressed down whereby the pressure can be transmitted to the pushrod 20 of the microswitch 18 for actuation thereof. The locking slider 14 is in the form of a one-piece injection moulding having a lower horizontal leg which defines a horizontal plane and which in the installation position bears over a surface area against the circuit board to distribute the pressure there, together with three legs which extend transversely relative to the plane of the horizontal leg, namely an actuating leg 15 provided at a first end, and two locking legs 22, 24 which are spaced relative to each other by the outside diameter of the buttons 8, 10, at the opposite end of the slider. By actuation of the actuating leg 15, the locking slider 14 which is movable with a translatory movement is movable from the release position shown in FIG. 1B in which the locking legs 22, 24 allow the buttons 8, 10 to be pressed down, into the locking position shown in FIG. 1C in which the locking legs 22, 24 are disposed at both sides beneath the rim of the buttons 8, 10 and thus prevent the buttons 8, 10 from being depressed and thus the pressure force applied is transmitted over a surface area to the circuit board 16 and from same by way of the vertical legs to the switch housing 2.

The second embodiment of the locking switch, shown in FIG. 2, is in the form of a chair switch for fitment in the armrest of a chair. This embodiment comprises a circular-cylindrical switch housing having a housing lower part 26 and a housing upper part 27 which can be fitted thereon in the form of a cap, the lower and upper parts 26 and 27 being in the form of one-piece plastic portions, of which the housing upper part 27 has a peripherally extending fixing flange 28 which in the installation position, after fitment of the switch housing into a suitable receiving opening of a chair, bears against it at the edge thereof, and can be covered by a cover ring 29 which can be fitted in position thereon by snapping engagement. Thus only the actuating end of the chair switch with the two buttons 30, 32 which are of a semicircular shape is visible, wherein a spacer leg 34 of the housing upper part 27 extends between the two buttons 30, 32. Provided centrally in the spacer leg 34 is a rectangular opening, through which the actuating leg 36 of a locking slider 38 projects.

Figure 2A:
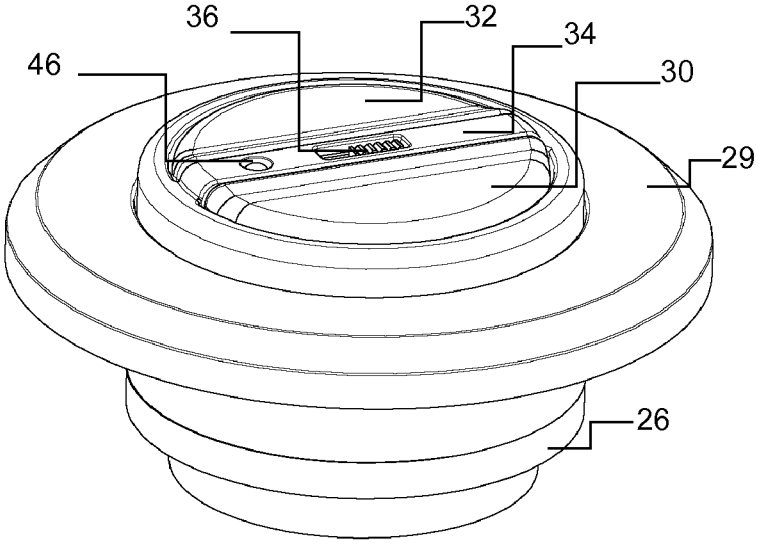
FIG. 2A shows a perspective view of a locking switch in the form of a chair switch for incorporation in an armchair.
Figure 2B:
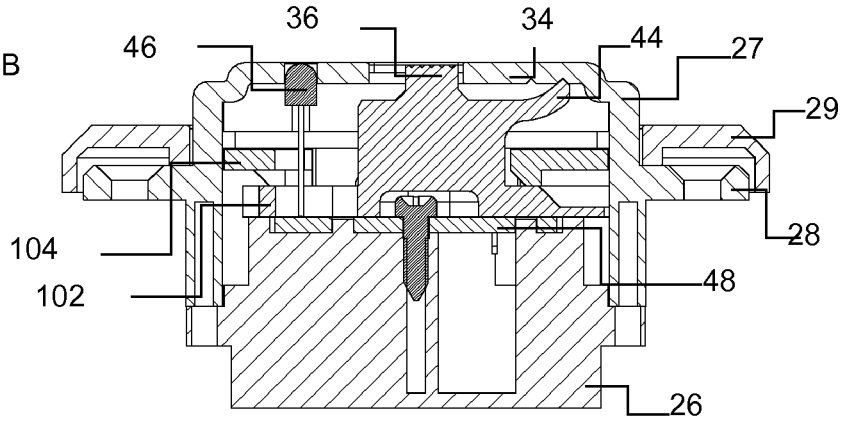
FIG. 2B shows a longitudinal section through the locking switch of FIG. 2A.
Figure 2C:
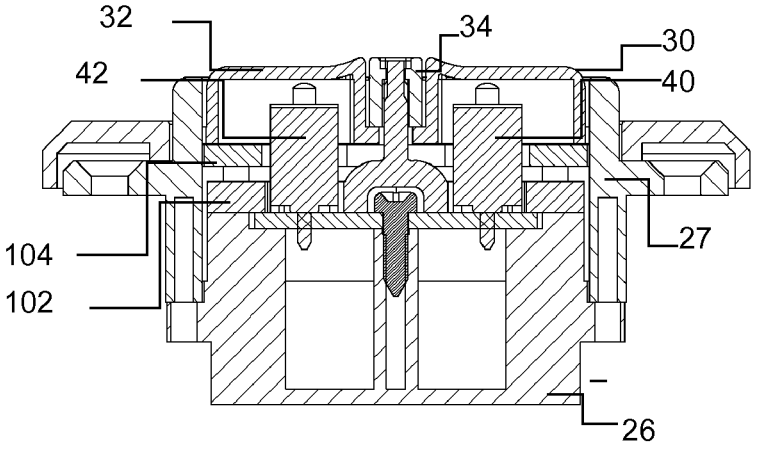
FIG. 2C shows a cross-section through the locking switch of FIG. 2A.
Figure 2D:
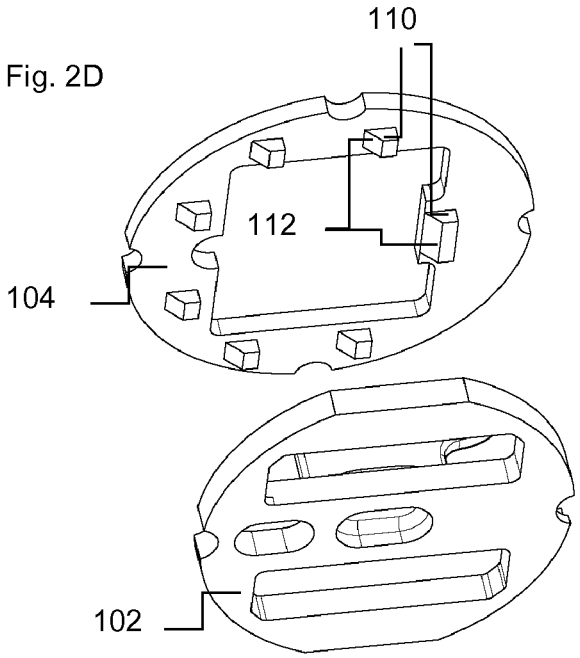
FIG. 2D shows a first perspective view of the lifting device of the switch of FIG. 2A.
Figure 2E:
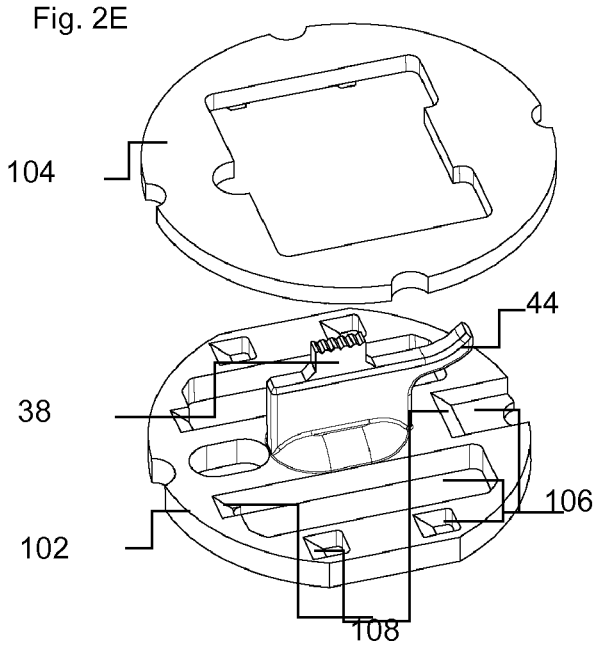
FIG. 2E shows a second perspective view of the lifting device of the switch of FIG. 2A.

This locking slider 38 which is in the form of a lifting device comprises the plates which are shown in perspective views in FIGS. 2D and 2E, wherein the view in FIG. 2D is a view of those plates from below and FIG. 2E is a view of the two plates from above. The locking slider 38 is thus formed by a lower plate 102 which is arranged downwardly in the installation position and a lift plate 104 which is of a complementary configuration thereto and which in the position of installation on the lower plate 102 has a central opening through which the actuating leg 36 of the lower plate 102 projects. At their peripheral edges, the plates 102, 104 which are substantially in the form of circular discs have a plurality of semicircular recesses for fixing them in position in the switch housing. Provided between the plates 102, 104 are lifting means which transform translation of the lower plate 102 into a lifting movement of the upper plate 104 in relation to the stationary lower plate 102. In the present case those lifting means include a plurality of depressions 106 which are formed in the lower plate 102 and which respectively have, at the left-hand sides in the Figure, a plurality of inclined run-on surface portions 103 with an angle of 45° relative to the horizontal, in respect of the depressions 106. In the present embodiment, a total of seven ramp projections 110 are integrally formed at the underside of the lift plate 104, which ramp projections 110 can be of differing widths and which in the installation position correspond with the depressions 106 and lower inclined run-on surface portions 108 in the lower plate 102, that is to say at the side on the left in the Figure, they have upper inclined run-on surface portions 112 which in the installation position act in complementary relationship with the lower inclined run-on surface portions 108 so that, in a translatory movement of the lower plate 102, they cause lifting of the lift plate 104 into the locking position, by virtue of the complementary inclined run-on surface portions 108, 112 sliding against each other.

The locking slider 38 further includes a latching arm 44 which extends in the longitudinal direction and which either engages in latching relationship into a corresponding release opening in the underside of the spacer leg 34 in the release position shown in FIG. 2B, or into a locking opening spaced from the release opening, for fixing in the locking position, in the underside of the spacer leg 34.

As shown in FIG. 2C the spacer leg 34 is of a U-shaped configuration, the opening facing downwardly in the illustrated view. In a manner not shown in greater detail, and in accordance with another embodiment of the locking slider which is also not shown in greater detail, the locking slider has, in portions thereof, shaped-out portions or shaped-in portions which correspond with shaped-in portions, shaped-out portions or with recesses or with spring legs of the limbs of the U-shaped spacer leg, in such a way that they are of an elastically yielding nature and are thus in the form of a latching means which can be overcome. When the locking slider is moved from the one end position into the other end position, that resistance formed by the latching means is overcome and the locking slider is simultaneously held in the respective end position.

In a further embodiment (also not shown) the ramp projections are shaped on or fitted to the buttons. In this embodiment there is no upper plate, this considerably simplifying assembly of the locking switch. In other words, a part of the lifting device is thus integrated into the buttons. In this embodiment the ramp projections fitted to the buttons also have corresponding inclined run-on surface portions, wherein the gradient of those inclined surface portions defines the resistance to be overcome.

In addition, fitted in recessed relationship in the spacer leg 34 is a control diode 46 with which the actuating direction and/or actuation of the buttons 30, 32 can be indicated by colour coding. The diode 46 is connected like the microswitches 40, 42 to a circuit board 48 fixed in an accurate position on the upper end of the housing lower part 26. In this embodiment of FIG. 2 also, the switch housing thus comprises the lower switch housing 26 which has the function of the lower half-shell portion for carrying the circuit board 48 in accordance with the embodiment of FIG. 1, and a housing upper part 27 which together with the housing lower part 26 forms the receiving space for the circuit board 48 and the electrical components. The lower housing part 26 and the upper housing part 27 are releasably fixed together with screws in the peripheral flange.

FIGS. 3 to 7 show various embodiments of the locking devices according to the invention in the form of longitudinal sections on an enlarged scale, fitted in a hand switch as shown in FIG. 1A. These Figures, besides the locking device, for the purposes of better clarity, only show the essential components, that is to say the housing upper shell portion 4, the button, the circuit board 16 and the microswitch 18, in order to clearly show the different configurations of the locking slider.

Figure 3A:
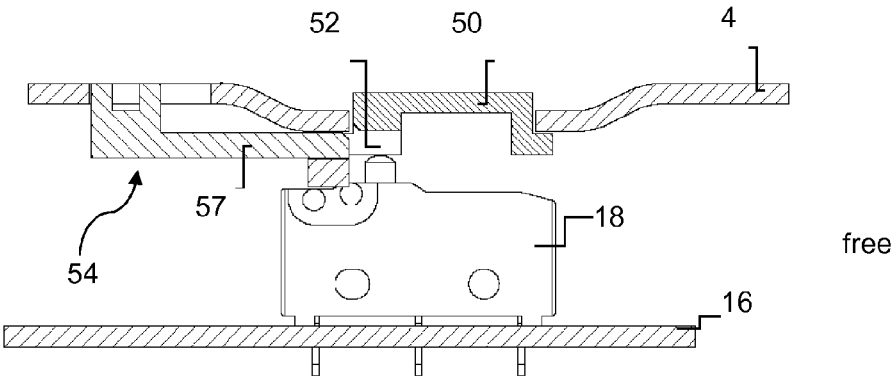
FIGS. 3A, 3B, 4A, 4B, 5A, 5B, 6A, 6B, 7A, and 7B show longitudinal sections which are respectively enlarged in pairs of various embodiments of the locking switch, wherein in each case Figure A denotes the switch in the release position and Figure B denotes the switch in the locking position.
Figure 3B:
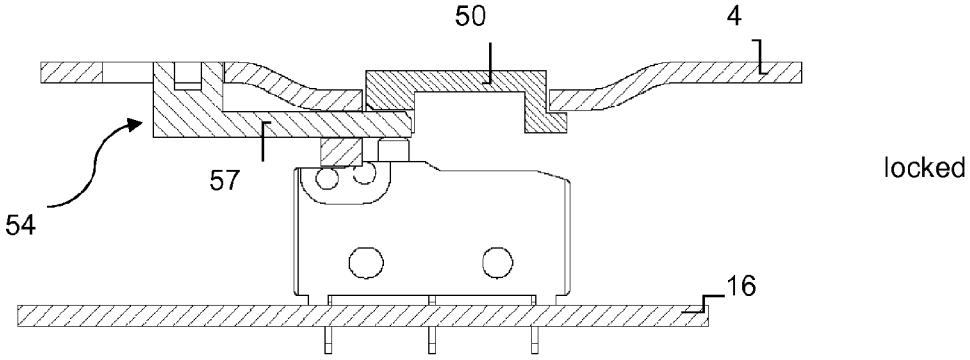

In the embodiment shown in FIG. 3 the button 50 has a slot-shaped recess 52 at one side. The horizontal portion 57 of the locking slider 54, which is received displaceably in the upper half-shell portion 4 of the switch housing 4, can be inserted in the recess 52, for locking purposes. In FIG. 3A that locking slider 54 is in the release position at the left in the Figure. In the locking position shown in FIG. 3B in contrast the locking slider 54 is displaced out of the left position shown in FIG. 3A into the right locking position so that the free end of the horizontal portion 51 of the locking slider 54 engages into the one-sided recess 52 in the button 50. The pressing force is thus transmitted by way of the button 50 and the locking slider 54 to the upper half-shell portion 56 of the switch housing to avoid loading the electrical components within the switch housing.

Figure 4A:
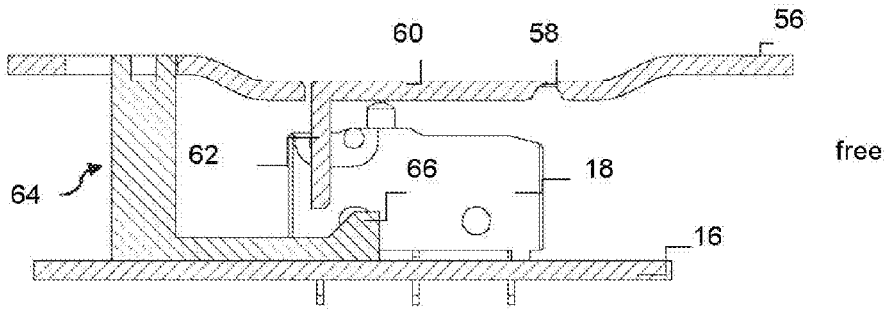
Figure 4B:
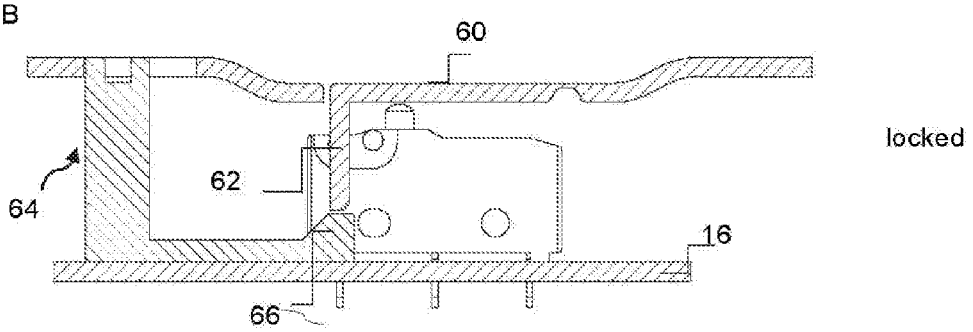
Figure 5A:
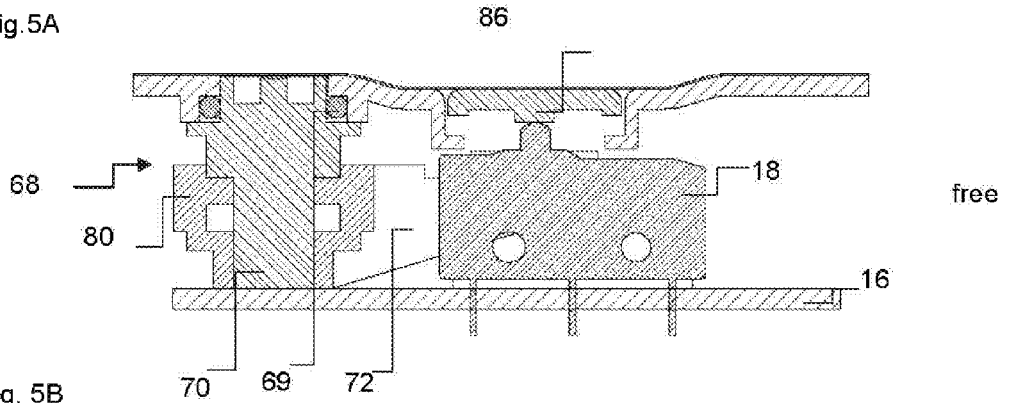
Figure 5B:
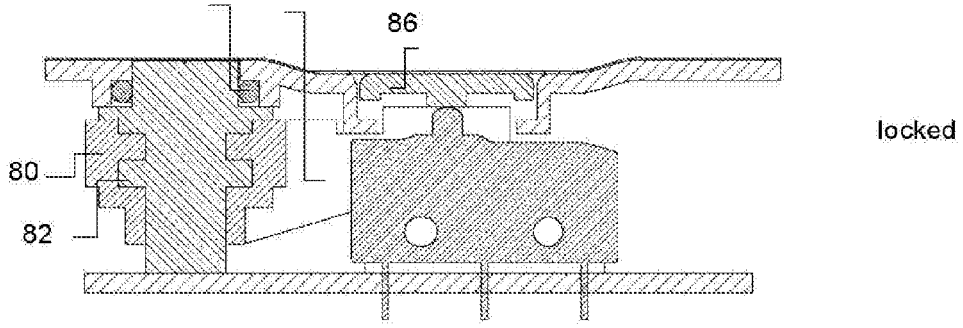
Figure 5C:
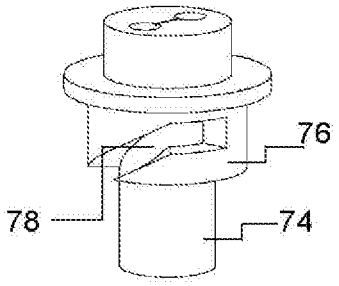
FIG. 5C shows an isolated front perspective view of an axis member included in FIGS. 5A and 5B.
Figure 5D:
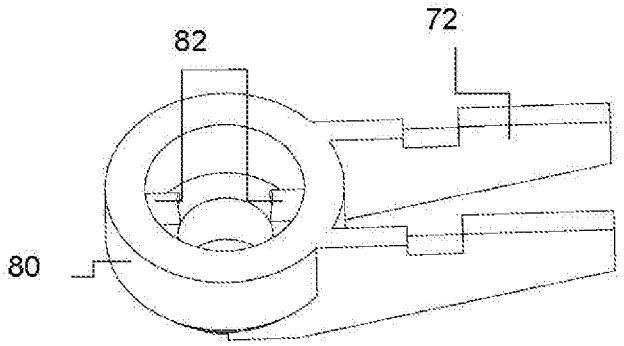
FIG. 5D shows an isolated front perspective view of a locking arm included in FIGS. 5A and 5B.

In the embodiment shown in FIG. 4 a button which is L-shaped in cross-section is integrally formed on the upper half-shell portion 56 of the switch housing and joined thereto by means of a film hinge 58. A horizontal leg 60 of that button, which is an upper leg in the installation position, forms the actual button region and a vertical leg 62 which extends vertically downwardly from the horizontal leg 60 at the free end projects as far as a certain spacing above the circuit board 16. In this embodiment also the locking slider 64 is arranged on the circuit board 16 movably with a translatory movement, that is to say longitudinally displaceably, between the locking and release positions, and at its rear free end which is at the right, it has a thickened portion 66 which bridges over the spacing between the lower end of the vertical leg 62 and the surface of the circuit board 16 in the locking position, in order to lock the button 60 against being depressed. At the same time the pressure force is transmitted from the button 60 by way of the locking slider 64 over a surface area to the circuit board 16 and the lower half-shell portion (this is not shown).

FIG. 5 shows various views of a locking device which is in the form of a rotary element and which is referred to hereinafter as a 'rotary locking member'. That rotary locking member 68 basically comprises two elements which are received in the switch housing, namely a central rotatable axis member 70 and a locking arm 72 arranged non-rotatably on the axis member 70. In the installation position the axis member 70 is received extending vertically in the switch housing and is rotatable through an upper opening with a corresponding key or wrench. The axis member 70 which is shown as a separate part in FIG. 5C is in the form of a general cylinder 74 on which a cylindrical enlargement portion 76 is formed at the upper end, approximately however at the centre. A peripherally extending sloped groove 78 is formed in the outer peripheral surface of the enlargement portion 76. The locking arm 72 shown as a perspective view in FIG. 5D includes a ring 80 having an internal recess in which the cylinder 74 of the axis member 70 can be fitted. Formed in a cylindrically enlarged upper region of the ring 80 are inwardly projecting, mutually diametrally opposite projections 72 which in the installation position engage into the sloped groove 78 in the axis member 70. By virtue of a rotary movement of the axis member 70 the projections 82 are guided in the sloped groove 78 so that the locking arm 72 is moved from the release position of being lowered, as shown in FIG. 5A, into the lifted locking position shown in FIG. 5B and in which arms 84 formed integrally at one side at the outer peripheral surface of the ring 80 are disposed beneath the button 86 and lock the button 86 to prevent it from being pressed down. The rotary locking member 68 is sealed with respect to the housing by way of an O-ring 69.

In a development of the embodiment shown in FIG. 5 the ring 80 has further arms 84 corresponding to a further button. Thus the rotary locking member 68 is adapted to either lock or release a number of corresponding buttons 86, preferably two buttons 86, for actuation purposes.

Figure 6A:
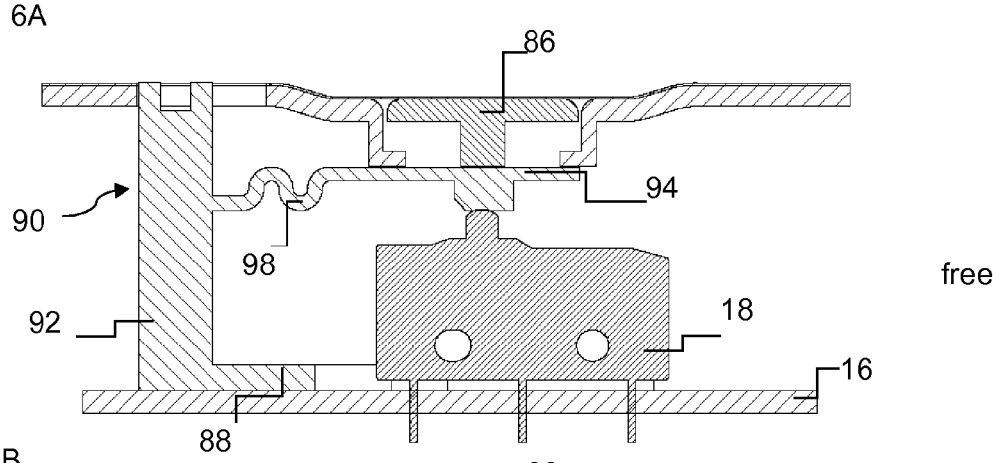
Figure 6B:
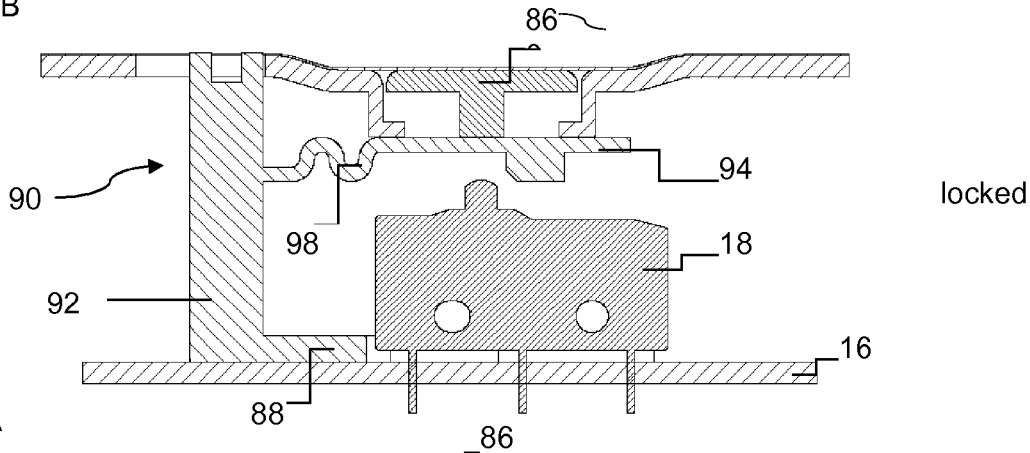
Figure 7A:
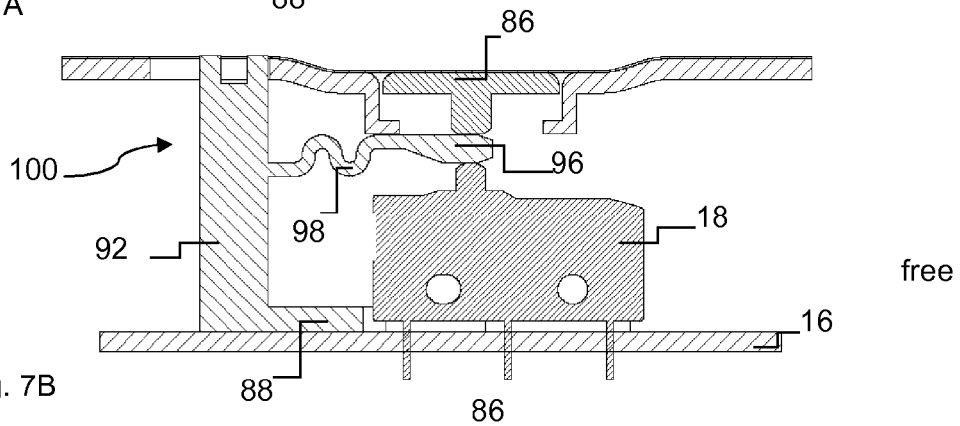
Figure 7B:
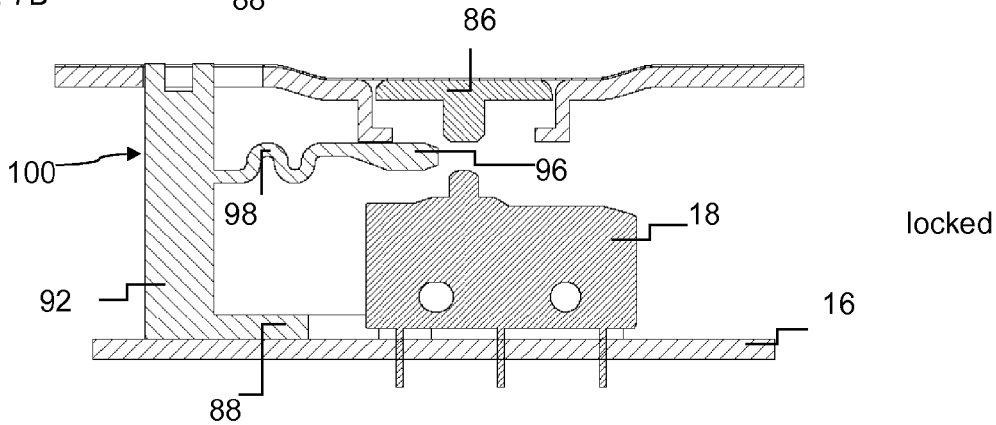

The embodiments of the locking devices, that are shown in FIGS. 6*a* and 7, are somewhat different in terms of their operative principle, from the above-described embodiments. In these embodiments more specifically the slider is used not for locking purposes but for the transmission of the pressure force from the button 86 to the pushrod of the microswitch 18. In both embodiments therefore the locking device is not in the form of a locking slider but in the form of a transmission slider for transmitting the pressure force of the button 86 in the release position. The release slider again has a horizontal plate 88 which in the installation position is disposed on the circuit board 16 and which in this embodiment additionally has a central opening around the microswitch 18. A vertical leg 92 which in the installation position extends inclinedly relative to the horizontal plate 88 is equipped with spring arms 94, 96 which are of different configurations and which project relative to the microswitch 18 and which in the release position shown in Figure A in respect of FIGS. 7 and 8 are disposed with an enlarged portion between the underside of the button 86 and the top side of the pushrod 20 of the microswitch 18, and thus transmit the pressure force from the button 86 to the pushrod 20 for actuation thereof, and a locking position which is respectively shown in Figure B in FIGS. 7 and 8 and in which the spring arms 94, 96 clear the space between the underside of the button 86 and the top side of the pushrod 20 so that depression of the button 86 admittedly causes deflection of the spring arms 94, 96, but not actuation of the pushrods 20 of the microswitches 18. For that purpose the spring arms 94, 96 are integrally formed on the vertical leg of the release slider 19, by way of spring portions 98 of a wave-shaped configuration.

For the sake of improved clarity of the drawing the Figures usually show only one microswitch on an enlarged scale. In that respect this involves a simplified view because the microswitches are usually but not necessarily always locked in pairs or in group-wise fashion.

Figure 8A:
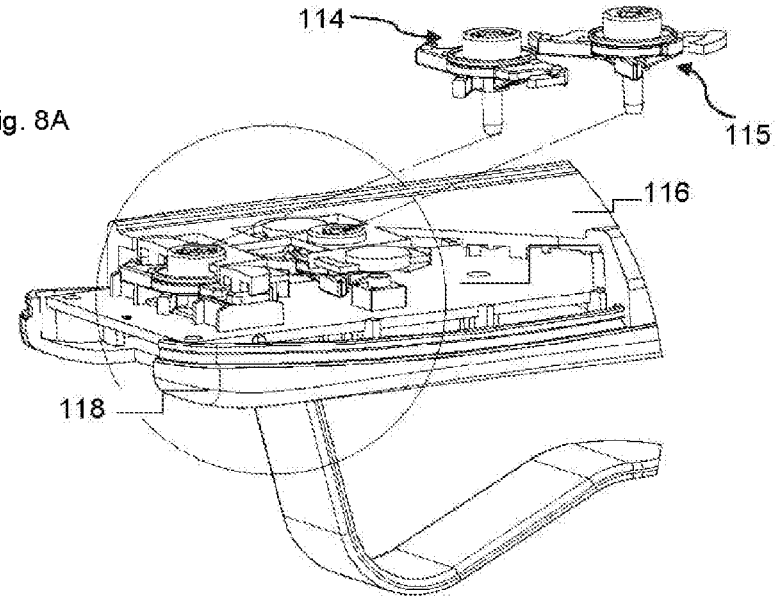
FIG. 8A shows a sectional view of a locking device in the form of a rotary locking member and a locking device in the form of a rotary transmission member, fitted in a hand switch.
Figure 8B:
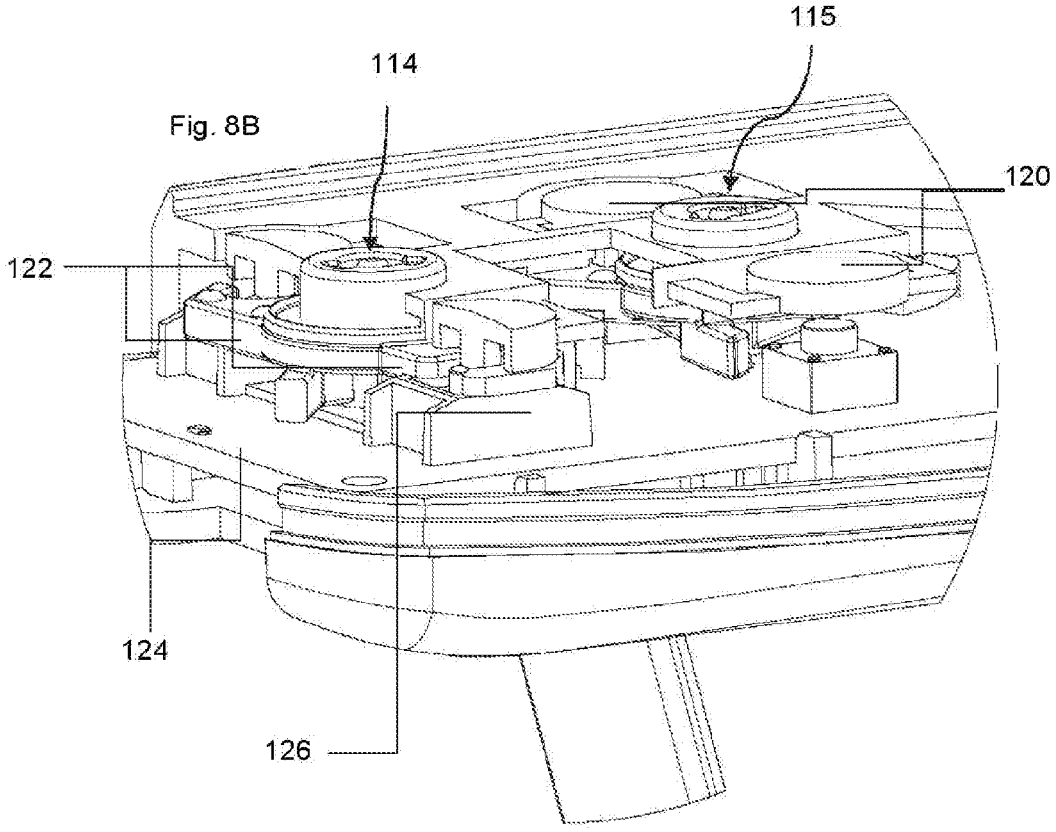
FIG. 8B shows an enlarged sectional view of the rotary member of FIG. 8A in the locking position.
Figure 8C:
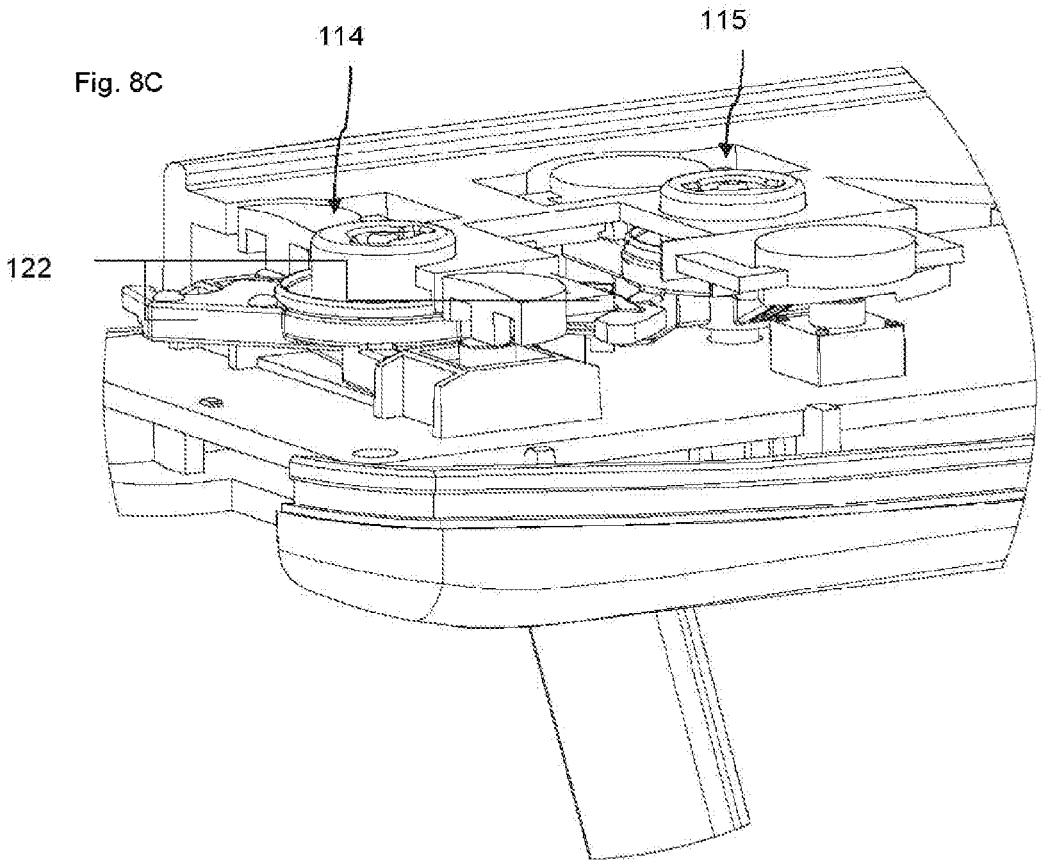
FIG. 8C shows an enlarged sectional view of the rotary member of FIG. 8A in the release position.

FIGS. 8A-8C show enlarged sectional views of a respective locking device in the form of a rotary locking member 114 and a locking device in the form of a rotary transmission member 115, installed in a hand switch, to clearly show the mode of operation involved, wherein each of the rotary members 114, 115 simultaneously either releases or locks two buttons 120 arranged in paired relationship one beside the other. FIG. 8A shows the rotary locking member 114 and the rotary transmission member 115 in the locking position. Each of the rotary members 114, 115 includes a respective central rotary cylinder, on which sickle-shaped arms 122 are integrally shaped at both sides in diametrally opposite relationship, with the inclusion of an angle of 180 degrees. Those arms 122 are of such a configuration that in the left-hand embodiment, in the form of a rotary locking member 114, they are disposed in the locking position at both sides beneath the underside of the outside edge of the buttons 120 and support same against the top side of the housings of the microswitches 126. When they are in the form of rotary transmission members 115 in contrast the arms 122 are of such a configuration that in the locking position they clear the space between the underside of the buttons 120 and the upper end of the pushrods of the microswitches. The buttons 120 arranged in pairs are accordingly simultaneously either locked or simultaneously unlocked after rotation of the rotary locking member 114 or the rotary transmission member 115 in accordance with the view in FIG. 8B, wherein in that view the arms 122 of the rotary locking member 114 are not arranged between the microswitches 126 and the buttons 120 and the arms of the rotary transmission member 115 are in contrast arranged in that way. For safeguarding displacement, the rotary movement is preferably possible only with a key or wrench which fits to the rotary locking member 114 or the rotary transmission member 115.

Figure 9A:
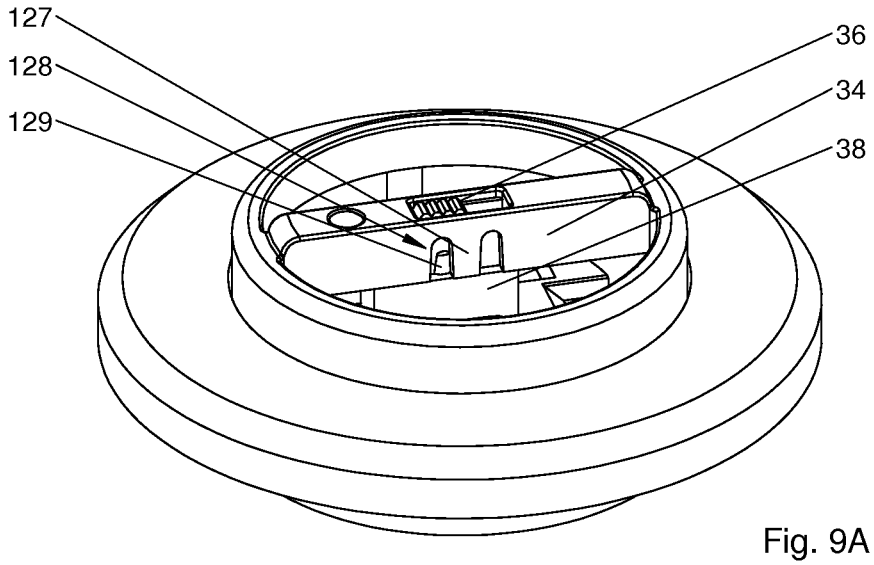
FIG. 9A shows a perspective view of parts of another chair hand switch as shown in FIGS. 2A to 2E in the release position.
Figure 9B:
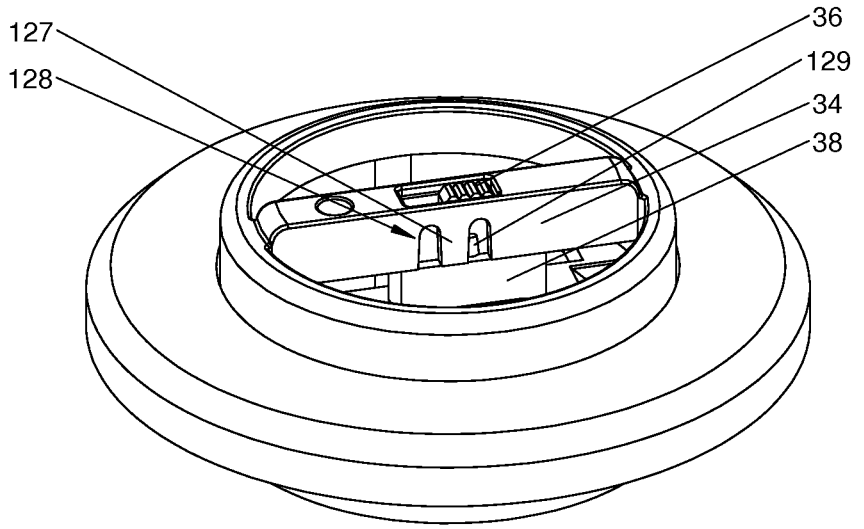
FIG. 9B shows a perspective view of the parts of another chair hand switch as shown in FIG. 9A in the locking position.
Figure 9C:
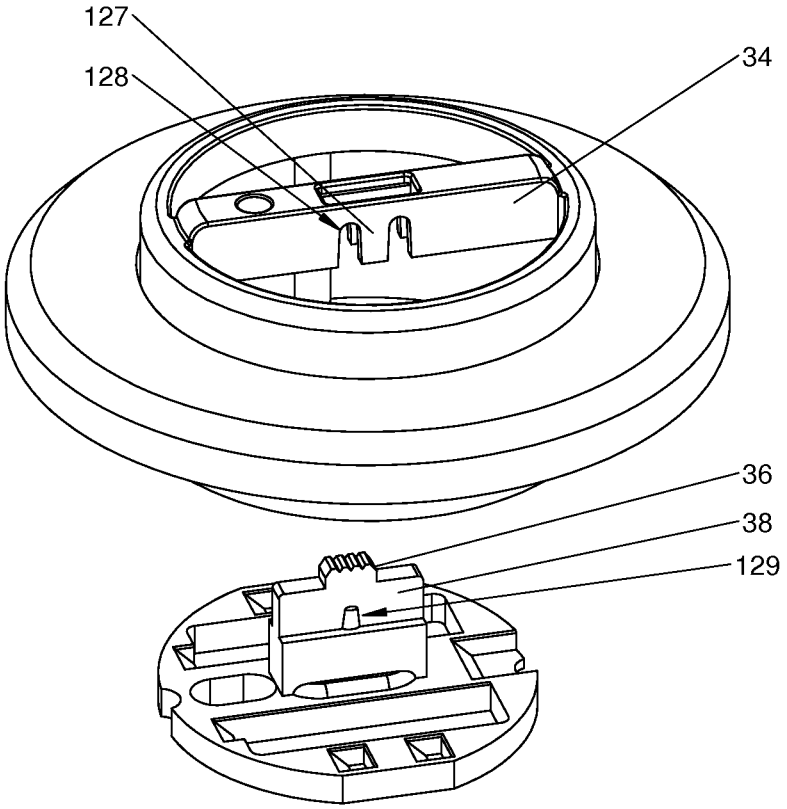
FIG. 9C shows a perspective view of the parts of another chair hand switch as shown in FIG. 9A as an exploded view.

FIGS. 9A to 9C illustrate a particular development of a chair switch shown in FIGS. 2A to 2E. The difference in this embodiment relative to the embodiments of FIGS. 2A to 2E lies in a different configuration of the latching action of the locking slider 38 in the release position and in the locking position. To better illustrate the structure and the mode of operation, components like the buttons 30, 32 and the microswitches 40, 42 are not shown in the perspective views. While FIG. 9A illustrates the release position the locking slider 38 has been moved into the locking position in FIG. 9B. In that case the locking slider 38 is connected to a first latching portion. In the view in FIGS. 9A to 9C the first latching portion is formed by a projection 129 connected to the locking slider 38.

That first latching portion corresponds with a second latching portion which is connected to the housing. The second latching portion is here a recess 128 which is part of the spacer leg 34. As described above the spacer leg 34 is part of the housing. In addition there is a resilient portion 127 arranged besides the recess 128. When the locking slider 38 is displaced from the release position into the locking position and back, the projection 129 passes the resilient portion 127 in going from one recess 128 to another and in so doing pushes it somewhat to the side so that the projection 129 is arranged in the respective recess 128 or engages somewhat thereinto there in the release position and in the locking position.

For the sake of simplified description of the mode of operation involved, the variants predominantly involve locking devices which are slidable or which operate with a translatory movement. Rotatable locking devices can also be used, similarly thereto. The locking devices which operate with a translatory movement implement the displacement in respect of height preferably by means of ramps or bevels which slide against each other on the complementary parts, whereas, in the case of the locking devices which operate with a rotary movement, a projection or pin is guided in an arcuate guide with a slope. The rotatable locking devices have the important advantage that a seal can be very easily fitted (as an additional component or as an elastomer component shaped on the structure).

The subject-matter of the present invention derives not only from the subject-matter of the individual claims but from the combination of the individual claims with each other. All features and details disclosed in the specification—including the Abstract—, in particular the spatial configuration shown in the drawing, are claimed as essential to the invention insofar as they are novel individually or in combination, over the state of the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A switch for switching a control or operating current of electric motors in linear transmissions, the switch comprising an outer housing having an upper part including at least one button (8, 10; 30, 32; 50; 60; 86) and a lower part for forming a receiving space, a circuit board (16, 48) received in the receiving space and having at least one microswitch having a microswitch housing and a spring-biased pushrod (20) therein, wherein upon actuation of the at least one button (8, 10; 30, 32; 50; 60; 86) by a user, the pushrod (20) actuates the at least one microswitch (18) for switching the control or operating current, wherein there is provided at least one locking element which can be displaced between a locking position of locking the at least one button (8, 10; 30, 32; 50; 60; 86) and a release position of releasing the at least one button (8, 10; 30, 32; 50; 60; 86), wherein the at least one locking element is adapted to transmit a pressure applied to the at least one button (8, 10; 30, 32; 50; 60; 86) to the microswitch housing and/or the circuit board (16, 48) over an area and the at least one locking element has a lifting device which transfers the at least one locking element from the locking position into the release position upon implementation of a translatory movement, the lifting device having a bottom plate and a lift plate which is vertically movable relative to said bottom plate, wherein the at least one locking element is designed such that a lifting motion of the at least one locking element occurs during the translatory movement.

2. A switch according to claim 1, wherein the at least one locking element is adapted to transmit the pressure at least partially to the housing of the microswitch (18).

3. A switch according to claim 1, wherein provided between the bottom plate (102) and the lift plate (104) are inclined run-on surfaces (108, 112) which are complementary and in a paired relationship.

4. A switch according to claim 1, wherein the at least one locking element has an arm which is either in the form of a locking arm or in the form of a bridging arm.

5. A switch according to claim 4, wherein the at least one locking element has a plurality of arms which simultaneously lock and unlock a plurality of buttons.

* * * * *